US006689183B2

(12) United States Patent
Gay

(10) Patent No.: US 6,689,183 B2
(45) Date of Patent: Feb. 10, 2004

(54) FERRITE POWDER COATING INSULATING LAYER FOR MOLDING A POWDER METAL CORE

(75) Inventor: David Earl Gay, Pendleton, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/757,139

(22) Filed: Jan. 9, 2001

(65) Prior Publication Data

US 2002/0088505 A1 Jul. 11, 2002

(51) Int. Cl.[7] ..... C22C 1/05; C22C 33/02; B22F 1/02

(52) U.S. Cl. ..... 75/232; 75/252; 419/64; 419/65

(58) Field of Search ..... 419/65, 64; 75/252, 75/232

(56) References Cited

U.S. PATENT DOCUMENTS

| | | | | |
|---|---|---|---|---|
| 5,211,896 A | | 5/1993 | Ward et al. | 264/126 |
| 5,321,060 A | | 6/1994 | Oliver et al. | 523/220 |
| 5,472,661 A | | 12/1995 | Gay | 419/36 |
| 5,543,174 A | | 8/1996 | Rutz | 427/213 |
| 5,567,746 A | | 10/1996 | Gay | 523/220 |
| 5,591,373 A | | 1/1997 | Ward et al. | 252/62.54 |
| 5,607,768 A | | 3/1997 | Lee | 428/403 |
| 5,629,092 A | | 5/1997 | Gay et al. | 428/407 |
| 5,637,402 A | | 6/1997 | Gay | 428/403 |
| 5,843,567 A | * | 12/1998 | Swift et al. | 428/221 |
| 6,110,420 A | | 8/2000 | Moorhead et al. | 419/35 |
| 6,136,265 A | * | 10/2000 | Gay | 419/5 |
| 6,179,894 B1 | * | 1/2001 | Gay | 75/230 |
| 6,193,903 B1 | * | 2/2001 | Gay et al. | 252/62.55 |

* cited by examiner

*Primary Examiner*—Daniel J. Jenkins
(74) *Attorney, Agent, or Firm*—Jimmy L. Funke

(57) ABSTRACT

A composition of metal powder for powder metallurgy applications comprising an iron-based powder metal admixed with a minority fraction of a ferrite powder having a lesser particle-size distribution. The ferrite particles are associated with an exterior surface of the iron-based particles and, after compression molding by a powder metallurgy technique, are incorporated into the microstructural pores between adjacent particles of iron-based powder. A composite structure formed from the composition of the present invention has an improved overall permeability and overall resistivity. A binder, such as a thermoplastic polyacrylate, may be added to the admixture of iron-based and ferrite powders for promoting the association of the ferrite powder with the iron-based powder.

31 Claims, 1 Drawing Sheet

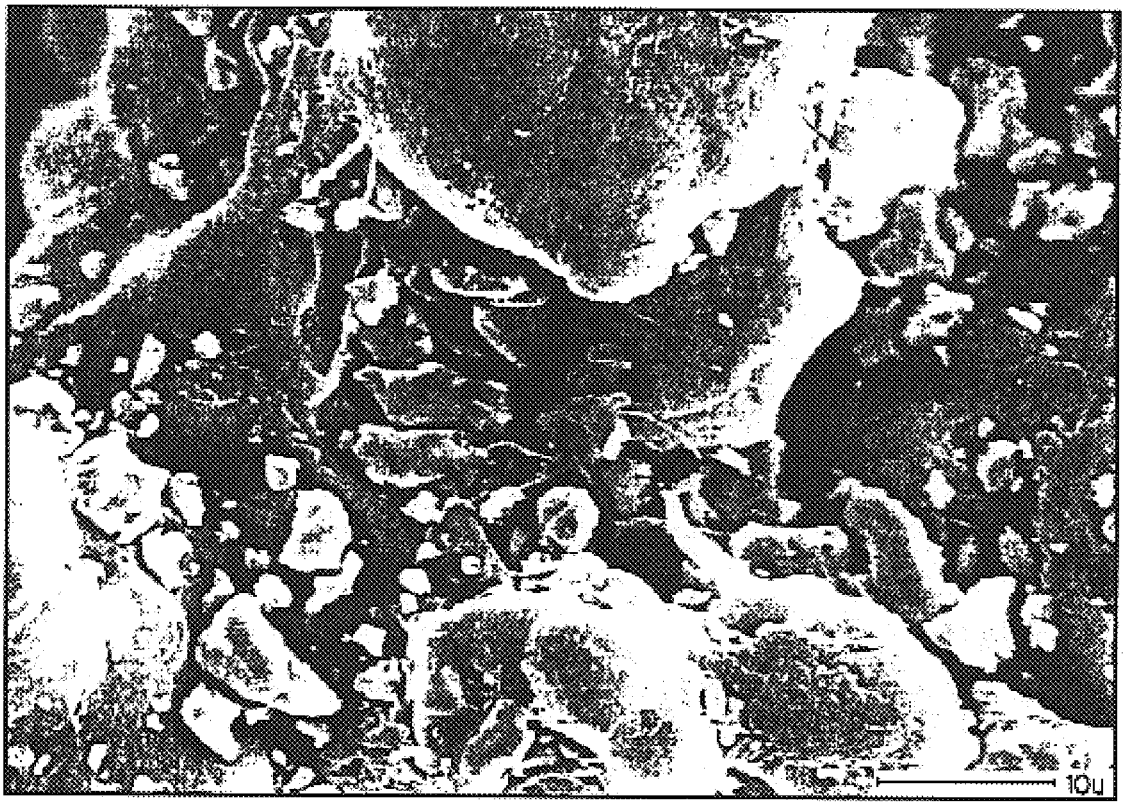
10u

FERRITE POWDER COATING INSULATING LAYER FOR MOLDING A POWDER METAL CORE

FIELD OF THE INVENTION

This invention relates to metal powder compositions and, in particular, to metal powder compositions in which an iron-based powder is admixed with a minority fraction of a ferrite powder having a smaller particle size distribution, and to composite structures formed from the metal powder composition.

BACKGROUND OF THE INVENTION

Manufacturers have begun to utilize powder metallurgy techniques to fabricate magnetic core components for alternating-current applications as replacements for core components made from laminated steel sheet. To that end, iron-based powders have been compressed by conventional powder metallurgy pressing techniques to produce a high density metallurgical compact for use as ignition cores, transformer cores, and stators and rotors for alternating-current and direct-current motors and generators. When judged solely by a manufacturing criterion, powder metallurgy techniques are efficient for producing core components having a desired net-shape or near to net-shape. However, metallurgical compacts formed from conventional iron-based powders by powder metallurgy techniques lack certain electromagnetic and physical properties that are highly desired in alternating-current applications.

When exposed to a rapidly varying electromagnetic field in alternating-current applications, core components formed of conventional iron-based powders are subject to undesirable hysteresis losses and eddy current losses. The eddy currents represent flows of electrical energy in the core component and opposed the desired flow. Eddy currents are converted into heat, which results in overheating and lowered efficiency of the core component. When compared with core components of laminated steel sheet, powder metal core components tend to exhibit inferior properties at frequencies less than about 500 Hz, such as significantly higher core losses To reduce the undesirable core and hysteresis losses, a uniform layer of one or more dielectric materials may be associated with the exterior of the particles of iron-based powder. Following compaction, the dielectric material electrically insulates individual particles from other adjacent particles. Because the insulation provided by the dielectric material persists following compaction, core losses are reduced in the magnetic core component. However, sintering has been found to degrade the interparticle insulation. Therefore, following compaction, green compacts formed from dielectric covered iron-based powders are usually not sintered or otherwise heated to a temperature sufficient to degrade the dielectric coating.

Among the most accepted dielectric materials are thermoplastic polymers. However, the presence of the polymer in the green compact significantly reduces the flux-carrying capacity and the permeability of the overall component to unacceptable levels for use as core components in certain alternating-current applications. In other alternating-current applications, green compacts formed from conventional iron-based powder compositions may lack the desired electrical resistivity because the polymer coating does not adequately separate adjacent particles of iron-based powder.

Thus, an iron-based powder composition that can be compacted by powder metallurgy techniques is needed for producing a green compact having acceptable physical properties, such as compact strength, and electromagnetic properties, such as permeability and resistivity.

SUMMARY OF THE INVENTION

The present invention provides a powder metal composition comprising an admixture of a collection of iron-based particles having a first particle size distribution and a collection of ferrite particles having a second particle size distribution. The ferrite particles constitute about 0.1 to about 10 percent by weight of the total weight of the admixture. The particle size distribution of the ferrite particles is generally less than the particle size distribution of the iron-based particles. In one embodiment, the iron-based powder have may a particle size distribution ranging between about 45 and about 500 microns and the ferrite particles have a particle size distribution ranging between about 1 and about 45 microns. To promote an association between the particles of the ferrite powder and the particles of iron-based powder, the iron-based powder may be coated with a binding agent, such as a thermoplastic polyacrylate, which encourages the ferrite particles to adhere to the exterior of the particles of the iron-based powder.

The presence of ferrite particles dispersed between adjacent iron-based particles increases the bulk resistivity of the compacted composite structure. The increased resistivity significantly reduces overall eddy current losses, which is particularly important for high frequency and low induction applications. The presence of the ferrite particles also fortifies the permeability of the compacted composite structure.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

The FIGURE is a scanning electron micrograph of iron-based particles associated with smaller ferrite particles.

DETAILED DESCRIPTION

According to the present invention, particles of an iron-based powder are admixed with smaller particles of a ferrite powder before a compression molding step to form a densified composite structure. The presence of the ferrite particles between adjacent particles of iron-based powder in the composite structure improves the overall permeability and the overall resistivity. A binding agent may be added to the admixture of iron-based and ferrite powders for enhancing the association of the ferrite powder with the iron-based powder. For additional insulation and binding between adjacent particles, the iron-based powder may be encapsulated with a uniform circumferential coating of a thermoplastic before admixing the iron-based powder with the ferrite powder and, thereafter, compression molding.

High-purity iron-based powders suitable for use in the present invention contains less than about 1.0 percent by weight, preferably no more than about 0.5 percent by weight, of unavoidable elemental impurities. Generally, iron-based powders comprise a collection of individual particles or grains having a particle size distribution ranging from about 5 microns to about 500 microns and, in certain embodiments, a particle size distribution ranging from about 5 microns to about 250 microns. For a particular alternating-current application, the iron-based powder may be sieved as required for providing a finer or coarser particle size distribution. Pre-alloyed iron-based powders may be also used in the present invention. Examples of such pre-alloyed iron-based powders include, but are not limited, to powders comprising an alloy of iron with one or more elements such as phosphorus, silicon, cobalt, vanadium, molybdenum, nickel, manganese, copper, and chromium and having less than about 1.0 percent by weight of unavoidable elemental impurities.

An example of an iron-based powder having a high compressibility and a high purity suitable for soft magnetic powder metallurgy applications is Ancorsteel® 1000C iron powder, which is commercially available from Hoeganaes Corporation (Riverton, N.J.). By way of specific example but not by way of limitation, Ancorsteel® 1000C iron powder has a particle size distribution of about 13 percent by weight of particles smaller than 45 microns, about 70 percent by weight of particles between 45 microns and 150 microns, and about 17 percent by weight of particles between about 150 microns to about 250 microns. The as-manufactured mass per unit volume, or apparent density, of the Ancorsteel® 1000C iron-based powder ranges from about 2.8 g/cm$^3$ to about 3.0 g/cm$^3$, and typically measures about 2.92 g/cm$^3$. The Ancorsteel® 1000C iron-based powder contains less than about 0.3 percent by weight of unavoidable elemental impurities and, in particular, extremely low levels of nitrogen and oxygen.

According to the present invention, the particles of the iron-based powder are admixed with smaller particles of a ferrite powder before compression molding to form a composite structure. Ferrite powders suitable for use in the present invention are ceramic-like, magnetically-soft ferrites having polycrystalline particles composed of ferric iron oxide and one or more other metals including, but not limited to, magnesium, aluminum, manganese, copper, zinc, nickel, cobalt, and iron. In an embodiment of the present invention, the ferrite comprises a magnesium ferrite which provides significant improvements in permeability and electrical resistivity to the composite structure.

Ferrites have a high magnetic permeability and a high electrical resistivity beneficial to alternating-current applications. However, ferrites also have a relatively low flux carrying capacity generally unsuitable for certain alternating-current applications. In a composite part formed of an admixture of iron-based and ferrite particles, the high magnetic permeability concentrates and reinforces the magnetic field, while the high electrical resistivity limits eddy currents between adjacent iron-based particles.

Before admixing with the iron-based powder, the ferrite powder is sieved with a sieve of an appropriate mesh to select a classification of particles having the desired particle size maximum. A ferrite powder appropriate for the present invention has a particle size distribution ranging from about 1 micron to about 50 microns and, in certain embodiments, the ferrite powder has a particle size distribution ranging from about 5 microns to about 10 microns. For purposes of efficient association and admixing between the iron-based and ferrite powders, the particle size distribution of the ferrite particles should be generally lesser than the particle size distribution of the iron-based particles. Generally, the particle size distribution of the ferrite particles should be weighted toward smaller particle sizes. However, the absolute particle size of the ferrite particles is less important, however, than their size in relation to the particle size of the iron-based particles. One ferrite powder suitable for the present invention is a magnesium-ferrite powder manufactured by Ceramic Powders Inc. (Joliet, Ill.).

According to the present invention, the ferrite and iron-based powders are uniformly admixed such that the smaller particles of ferrite powder are uniformly distributed among and associated with the larger particles of iron-based powder. The amount of ferrite powder added to the iron-based powder may range from about 0.1 percent by weight to about 50 percent by weight and usually ranges from about 0.25 percent by weight to about 2 percent by weight. However, the desired amount of ferrite powder in the admixture will depend upon the particular magnetic core application. Amounts of ferrite powder less than 0.25 percent by weight may enhance the electrical insulation between adjacent iron-based particles without significantly altering the magnetic properties. Although amounts of ferrite powder greater than about 2 percent by weight may further enhance the permeability of the composite structure, such a composition may dilute other magnetic properties, such as flux carrying capacity.

Generally, the compositions of the present invention can be made by admixing the iron-based particles and the ferrite particles, preferably in dry form, using conventional mechanical admixing techniques to form a substantially homogeneous admixture of the iron-based and ferrite powders. Mechanical admixing techniques using devices for homogenizing an admixture of powders, such as V-blenders or double cone blenders, are familiar to those of ordinary skill in the art of powder metallurgy. The homogeneous admixture of the ferrite and iron-based powders persists until the admixture is compacted by a suitable compaction technique to form a composite structure.

Alternatively, the ferrite powder may be associated with the iron-based powder by a solution-blending or slurry-mixing technique. To this end, a binder or binding agent is dissolved in a suitable organic solvent and the particles of iron-based powder and ferrite powder are added to the solution to form a slurry. As the slurry is mixed, the solvent is evaporated and the ferrite particles are adhered to the iron-based particles by the binding agent. The binding agent promotes the association of the ferrite particles with the iron-based particles by providing a tackified layer or coating on the external surfaces of the iron-based particles and the ferrite particles. The association between the ferrite and iron-based powders persists until the admixture is compacted by a suitable compaction technique to form a composite structure. Although it is desirable to not sinter the composite compact, the composite structure may heat treated following compaction to a temperature sufficient to volatize and remove the binding agent.

The tackified layer of binding agent comprises about 0.01 percent by weight to about 0.2 percent by weight of the coated iron-based particles, which is sufficient to promote adequate adhesion between the ferrite particles and the iron-based particles. However, a greater or lesser amount of binding agent may be present without departing from the spirit and scope of the present invention. Suitable binding agents include, but are not limited to, thermoplastics soluble in an organic solvent, such as polyacrylates, polystyrenes, polycarbonates, polysulfones, polyether-imides, polyether sulfones, and polyamide-imides. An exemplary thermoplastic polyacrylate is commercially available from Rohm & Haas under the trade name Acryloid®.

In the admixture, a significant number of the ferrite particles is associated with an exterior surface of a significant number of the larger particles of iron-based powder. In certain embodiments, a significant number of the ferrite particles is associated with the exterior surface of each of the particles of iron-based powder. In other certain embodiments, the ferrite particles at least partially cover the surface of a significant number of iron-based particles. For purposes of illustrating the association, a sample of admixed ferrite and iron-based powders of the present invention was analyzed by scanning electron microscopy. Referring to the FIGURE, a scanning electron micrograph from this analysis illustrates a typical association between the ferrite particles and the larger iron-based particles in the admixture. Generally and with reference to the FIGURE, particles having feature sizes on the order of or smaller than about 10 microns may be identified as ferrite particles and the larger particles may be identified as iron-based particles. Due to the difference in relative particle size, several ferrite particles are associated with the exterior surface of each iron-based particle.

The admixture of iron-based powder and ferrite powder can be formed into a composite structure by a suitable compaction technique, such as compression molding, that produces a metallurgical compact. In compression molding, a confining form, such as a die or cavity having a predetermined shape, is charged or filled with a quantity of the admixed powder. A compression pressure is applied for compacting and densifying the admixed powder into a composite structure, generally forming interparticle bonds between iron-based particles. The compression molding may occur at room or ambient temperature or the cavity, the admixed powder, or both may be heated to a temperature less than the melting point of the constituents of the admixed powder. Compression pressures in conventional compaction methods range from about 5 tons per square inch (tsi) to about 200 tsi, typically in the range of about 30 tsi to about 60 tsi. The pressure needed is dependent primarily upon the composition of the particular iron-based powder. Alternatively, a compaction technique such as isostatic pressing or electromagnetic pressing can be used to compact the admixed powder by applying nominally equal compression pressure from every direction. Other compaction techniques may be used within the scope of the present invention as determined by one ordinarily skilled in the art.

For the chosen compaction technique, pressures and temperatures are selected to cause the discrete particles or grains of the admixed ferrite and iron-based powders to become mechanically interlocked and to form a highly-dense and strong green compact that comprises the composite structure. For most applications, a green density is desired that is approximately 90 percent or greater of the theoretical density of the bulk iron-based material. Following compaction, the composite structure will be substantially formed to a desired net shape or near to net-shape form. However, additional machining may be required to prepare the composite structure for use as a magnetic core component.

After compaction of the admixed ferrite and iron-based powders, the composite structure typically lacks fill theoretical density and incorporates an extended network of microstructural pores or voids. In the composite structure, the particles of ferrite powder are positioned in the microstructural pores between adjacent particles of the iron-based powder. According to the present invention, the ferrite particles are present in an amount and with locations such that a significant fraction of the adjacent iron-based particles are physically and electrically separated. Because of the high resistivity of the intervening ferrite particles, adjacent iron-based particles are electrically insulated. The dispersion of the ferrite particles among the larger particles of iron-based powder improves the overall permeability and the overall resistivity of the composite structure, particularly for those alternating current applications at frequencies below about 500 Hz. For optimum efficacy in improving permeability and resisitivity, the dispersion of the ferrite particles should homogeneous throughout the bulk of the composite structure. However, a non-homogeneous dispersion of ferrite particles in the composite structure would could still significantly improve the permeability and resisitivity of the composite structure.

In certain embodiments, the admixed iron-based and ferrite powders may be further admixed with a lubricant powder, such as a metal stearate or a synthetic wax, to facilitate the pressing and ejection of the green compact. The lubricant reduces the coefficient of friction between particles so that the compacted powder can achieve a higher green strength. Other lubricants known to those of ordinary skill in the art of powder metallurgy may be used without departing from the spirit or scope of the invention. The lubricant is associated with the iron-based and ferrite powders by any one of various methods familiar to one of ordinary skill in the art of powder metallurgy that uniformly distributes the lubricant throughout the admixture, such as V-blending or solution blending. Although it is desirable to leave the green composite compact unsintered, the composite structure may heat treated or delubed following compaction to a temperature sufficient to volatize and remove the lubricant.

According to the present invention, the individual particles of iron-based powder may also be encapsulated or coated within a substantially uniform, circumferential coating of a thermoplastic before compaction. Following compaction, the thermoplastic separates and electrically insulates adjacent particles. The coating of thermoplastic is associated with the powder by any one of various methods that uniformly coats the particles with the thermoplastic material familiar to those of ordinary skill in the art of powder metallurgy. For example, the thermoplastic may be dissolved in an organic solvent and fluidized in a Wurster-type fluid bed coating process. Alternatively, thermoplastic particulates can be admixed with the ferrite and iron-based powders. During compaction, the thermoplastic particulates adhere or bond to the exterior surface of the iron-based particles and flow to partially fill, along with the ferrite particles, the microstructural pores in the composite structure. If provided in powder form, the thermoplastic is admixed with the iron-based and ferrite powders by a method familiar to those in the art of powder metallurgy.

Sufficient thermoplastic material is applied to provide a coating of about 0.01 percent by weight to about 15 percent by weight, typically about 0.4 percent by weight to about 2 percent by weight, of the coated iron-based particles. Thermoplastic materials suitable for practicing the present invention include, but are not limited to, any polymeric material that can act as an insulator, that can be intimately associated with the iron-based particles, and that can retain an association with the iron-based particles following compaction. Exemplary thermoplastics, without limitation, suitable for use in the present invention include polyether-imides, polyether sulfones, polyamide-imides, and combinations thereof.

Thermoplastic resins suitable for the present invention have a high mechanical strength, a high thermal stability, and a broad chemical resistance, and should be soluble in an organic solvent to facilitate association with the iron-based powder. An exemplary family of polyether-imide thermoplastic resins is commercially available from General Electric Company under the trade name Ultem®. An exemplary polyether sulfone thermoplastic resin is commercially available from BP Amoco under the trade name Udel®. A suitable polyamide-imide thermoplastic resin is available commercially from BP Amoco under the trade name Torlon®.

The powder compositions of the present invention produce homogeneous compacts having high green density, reduced core losses, and acceptable magnetic permeability over an extended frequency range. The presence of the minority concentration of ferrite particles in the microstructural pores between adjacent iron-based particles provides electrical insulation to increase the bulk resistivity and fortifies the magnetic permeability of the composite structure. The increased resistivity significantly reduces overall eddy current losses, which is particularly important for high frequency and low induction applications.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. For example, a ferrite powder may be admixed with powder metals that are not iron-based in a manner consistent with the present invention for fortifying the permeability or the resistivity of a compacted structure formed by conventional powder metallurgy techniques. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A composition of particles for compaction into a magnetic core component comprising an admixture of a collection of iron-based particles having a first particle size distribution ranging between about 5 microns and about 500 microns and a collection of ferrite particles having a second particle size distribution ranging between about 1 micron and about 50 microns, wherein said ferrite particles constitute about 0.1 to about 50 percent by weight of the total weight of the admixture and the balance iron-based particles.

2. The composition of claim 1 wherein said iron-based particles have a particle size distribution ranging between about 5 microns and about 250 microns and said ferrite particles have a particle size distribution ranging between about 5 microns and about 10 microns.

3. The composition of claim 1 wherein said ferrite particles comprise an alloy of ferric iron oxide and a metal selected from the group consisting of magnesium, aluminum, manganese, copper, zinc, nickel, cobalt, iron and combinations thereof.

4. The composition of claim 1 further comprising a binding agent applied to an exterior surface of said iron-based particles, wherein said binding agent associates said particles of ferrite with an exterior surface of said iron-based particles.

5. The composition of claim 4 wherein said binding agent is selected from the group consisting of polyacrylates, polystyrenes, polycarbonates, polysulfones, polyether-imides, polyether sulfones, polyamide-imides and combinations thereof.

6. The composition of claim 1 further comprising a substantially uniform coating of a thermoplastic encapsulating said iron-based particles.

7. The composition of claim 6 wherein said thermoplastic is selected from the group consisting of polyether-imides, polyether sulfones, polyamide-imides, and combinations thereof.

8. The composition of claim 1 further comprising a lubricant powder admixed with said iron-based particles and said ferrite particles.

9. The composition of claim 1 wherein said ferrite particles constitute about 0.25 percent by weight to about 2 percent by weight of the total weight of the admixture.

10. The composition of claim 1 wherein the iron-based particles comprise an alloy of iron and a metal selected from the group consisting of phosphorus, silicon, cobalt, vanadium, molybdenum, nickel, manganese, copper, chromium and combinations thereof.

11. A metallurgical compact prepared from the composition of claim 1.

12. A metallurgical compact prepared from the composition of claim 2.

13. A metallurgical compact prepared from the composition of claim 3.

14. A metallurgical compact prepared from the composition of claim 4.

15. A metallurgical compact prepared from the composition of claim 5.

16. A metallurgical compact prepared from the composition of claim 6.

17. A metallurgical compact prepared from the composition of claim 7.

18. A metallurgical compact prepared from the composition of claim 8.

19. A metallurgical compact prepared from the composition of claim 9.

20. A metallurgical compact prepared from the composition of claim 10.

21. A method for manufacturing a composite structure comprising:

admixing particles of an iron-based powder with a minority fraction by weight of particles of a ferrite powder to provide a substantially uniform admixture;

assembling the admixed particles in a cavity; and applying pressure to the admixture of said particles of said iron-based and ferrite powders to form the composite structure, wherein the particles of the ferrite powder occupy positions between the particles of the iron-based powder for providing electrical insulation between adjacent particles of the iron-based powder and for enhancing the permeability of the composite structure.

22. The method of claim 21 further comprising applying a binding agent to an exterior surface of the particles of the iron-based powder, wherein said binding agent associates the particles of the ferrite powder with an exterior surface of the particles of the iron-based powder.

23. The method of claim 22 wherein the binding agent is selected from the group consisting of polyacrylates, polystyrenes, polycarbonates, polysulfones, polyether-imides, polyether sulfones, polyamide-imides and combinations thereof.

24. The method of claim 21 further comprising applying a substantially uniform encapsulating coating of a thermoplastic to an exterior surface of each of the particles of the iron-based powder.

25. The method of claim 24 wherein said thermoplastic is selected from the group consisting of polyether-imides, polyether sulfones, polyamide-imides, and combinations thereof.

26. The method of claim 21 further comprising admixing a lubricant powder with the particles of the iron-based powder and the particles of the ferrite powder.

27. The method of claim 21 wherein the particles of the iron-based powder have a particle size distribution ranging between about 5 microns and about 500 microns and the particles of the ferrite powder have a particle size distribution ranging between about 1 micron and about 50 microns.

28. The method of claim 27 wherein the particles of the iron-based powder have a particle size distribution ranging between about 5 microns and about 250 microns and the particles of the ferrite powder have a particle size distribution ranging between about 5 microns and about 10 microns.

29. The method of claim 21 wherein the ferrite particles constitute about 0.25 to about 2 percent by weight of the total weight of the admixture of the iron-based and ferrite powders.

30. The method of claim 21 wherein the particles of the ferrite powder comprise an alloy of ferric iron oxide and a metal selected from the group consisting of magnesium, aluminum, manganese, copper, zinc, nickel, cobalt, iron and combinations thereof.

31. The method of claim 21 wherein the particles the iron-based powder comprise an alloy of iron and a metal selected from the group consisting of phosphorus, silicon, cobalt, vanadium, molybdenum, nickel, manganese, copper, chromium and combinations thereof.

* * * * *